US006277211B1

(12) United States Patent
Panchanathan et al.

(10) Patent No.: US 6,277,211 B1
(45) Date of Patent: Aug. 21, 2001

(54) CU ADDITIONS TO ND-FE-B ALLOYS TO REDUCE OXYGEN CONTENT IN THE INGOT AND RAPIDLY SOLIDIFIED RIBBON

(75) Inventors: Viswanathan Panchanathan, Anderson; Robert Eugene Dickey, Middletown, both of IN (US)

(73) Assignee: Magnequench Inc., Anderson, IN (US)

( * ) Notice: Subject to any disclaimer, the term of this patent is extended or adjusted under 35 U.S.C. 154(b) by 0 days.

(21) Appl. No.: 09/410,473

(22) Filed: Sep. 30, 1999

(51) Int. Cl.[7] ..... H01F 1/03
(52) U.S. Cl. ..... 148/101; 148/540
(58) Field of Search ..... 148/101, 540

(56) References Cited

U.S. PATENT DOCUMENTS

| | | | | |
|---|---|---|---|---|
| 4,770,723 | | 9/1988 | Sagawa et al. . | |
| 4,792,367 | | 12/1988 | Lee . | |
| 4,792,368 | | 12/1988 | Sagawa et al. . | |
| 4,844,754 | | 7/1989 | Lee . | |
| 4,902,361 | | 2/1990 | Lee et al. . | |
| 4,995,905 | * | 2/1991 | Sagawa | 75/244 |
| 5,009,706 | * | 4/1991 | Sakamoto et al. | 75/244 |
| 5,125,988 | * | 6/1992 | Akioka et al. | 148/101 |
| 5,356,489 | * | 10/1994 | Nozieres et al. | 148/101 |
| 5,645,651 | | 7/1997 | Fujimura et al. . | |

* cited by examiner

*Primary Examiner*—John Sheehan
*Assistant Examiner*—Andrew L. Oltmans
(74) *Attorney, Agent, or Firm*—Pennie & Edmonds LLP

(57) ABSTRACT

A process is disclosed for producing rare earth-iron-boron alloys and magnets with reduced oxygen content and improved yield. Such a reduction in oxygen content and improvement in yield are achieved by including copper in a melt having a composition comprising a rare earth, boron, and iron, and subsequently solidifying the melt.

30 Claims, No Drawings

CU ADDITIONS TO ND-FE-B ALLOYS TO REDUCE OXYGEN CONTENT IN THE INGOT AND RAPIDLY SOLIDIFIED RIBBON

FIELD OF THE INVENTION

The present invention relates to processes for reducing the oxygen content and/or improving the metal yield in alloys and permanent magnets having a rare-earth iron-boron composition, and to alloys and magnets produced by such processes.

BACKGROUND OF THE INVENTION

Rare earth-iron-boron based magnets, such as the well known Nd—Fe—B magnets, are used in numerous applications, including computer hardware, automobiles, consumer electronics and household appliances. In particular, magnets using rare earth elements, such as Nd or Pr, are useful primarily because of their superior magnetic properties, as manifested by their large coercivity, remanence, magnetization, and maximum energy product. The primary disadvantage of such magnets is that because of the cost of scarce rare earth metals, such as Nd or Pr, they are relatively expensive to make.

There are several known methods to fabricate rare earth-iron-boron magnets. In such methods, the constituent metals are melted together and subsequently solidified. Solidification is achieved by different techniques which include cooling, melt spinning, and annealing. The solidified alloy may take the form of an ingot, ribbon, flakes, or powder. Methods for fabricating magnets include sintering, hot pressing, hot deformation, and bonding. The process for making a sintered permanent rare earth magnet is well known and is described in, for example, U.S. Pat. Nos. 4,770,723, 4,792,368 and 5,645,651, which are incorporated herein by reference. The processes for making a hot-pressed or hot-deformed magnet are also well known and are described in, for example, U.S. Pat. Nos. 4,792,367 and 4,844,754, where are incorporated herein by reference. The process for making a bonded magnet is well known and is described in, for example, U.S. Pat. No. 4,902,361, which is incorporated herein by reference.

The oxygen content of the alloy or magnet affects its magnetic properties. A high oxygen content in the alloy causes a decline in the coercivity of the permanent magnet, preventing it from obtaining a high energy product. It is therefore desirable to have a process by which rare earth-iron-boron alloys and magnets are produced which limits their oxygen content. It is also desirable to have a process by which the metal yield from rare earth-iron-boron alloys is improved without adversely affecting the magnetic properties of the powder or magnet that may be formed.

SUMMARY OF THE INVENTION

The present invention is directed to a process for preparing a rare earth-iron-boron alloy that results in reduced oxygen content and/or greater yield. The process comprises the steps of preparing a melt having a composition comprising a rare earth, boron, iron, and copper; and solidifying the melt. In different embodiments, the melt further comprises cobalt, dysprosium, and/or gallium.

Preferably, the melt comprises approximately 15 to 34 weight percent of the rare earth, 0.8 to 1.4 weight percent of boron, and balanced with iron; the rare earth preferably consists of Nd and Pr. Cu is preferably included in the melt in the form of pure Cu, and preferably in a proportion less than 0.2 weight percent. In specific embodiments of the invention, the step of solidifying comprises cooling or melt spinning.

The present invention is further directed to a rare earth-iron-boron alloy produced according to this process. As used herein, the term "rare earth-iron-boron alloy" encompasses an alloy in any form, including, without limitation, forms where the alloy is particulate, powdered (i.e. with a particle size less than 400 microns), flaked, ribboned, and cast as an ingot.

The invention is further directed to a process for preparing a permanent rare earth-iron-boron magnet that comprises the steps of preparing a melt having a composition comprising a rare earth, boron, iron, and copper; solidifying the melt; and fabricating the permanent rare earth-iron-boron magnet from the solidified melt. Different embodiments for preparing a permanent magnet include aspects that correspond to those recited above for preparing a rare earth-iron-boron alloy.

The invention is also directed to a permanent rare earth-iron-boron magnet made by this process. As used herein, the phrase "permanent rare earth-iron-boron magnet" encompasses any permanent magnet, including a magnetic particle, a magnetic powder, a magnetic flake, a bonded magnet, and a fully dense isotropic or anisotropic magnet. Such magnets include, without limitation, sintered, hot-pressed, hot-deformed, and bonded magnets.

DETAILED DESCRIPTION OF THE INVENTION

The present invention will be described in detail with the following examples.

EXAMPLE 1

Three 5 lbs (2270 g) alloy heats were made in a vacuum induction furnace having the following composition: 30.5 weight percent total rare earth (which consisted primarily of Nd and Pr), 1 percent boron, and balanced with iron. The oxygen content of the three alloy samples was determined to be 0.025 weight percent, 0.015 weight percent, and 0.041 weight percent, with an average value of 0.027 weight percent.

EXAMPLE 2

Three alloy heats were made as in Example 1, with raw material taken from the same lot to avoid variation in the raw material affecting the quality of the melt. For two of the heats, 0.15 weight percent Cu was added in the form of pure Cu. For the third heat, 0.1 weight percent Cu was added. The oxygen content of the metal was determined to be 0.014 weight percent and 0.018 weight percent for the first two heats, and 0.011 weight percent for the third heat. Thus, the average oxygen content in the metal including Cu was 0.0143 weight percent, which is almost 50 percent less than the value obtained in Example 1.

EXAMPLE 3

After performing the measurements described in Examples 1 and 2, the slag for each of the alloy heats was measured. Thus, a comparison of the oxygen content in the slag with and without including Cu in the melt is possible. Without the inclusion of Cu, the slag of the three alloy heats from Example 1 respectively contained 1.8 weight percent, 1.4 weight percent, and 0.1 weight percent oxygen, for an average value of 1.1 weight percent. With the Cu included, the slag of the three alloy heats from Example 2 respectively contained 2.9 weight percent, 8.0 weight percent, and 5.5 weight percent oxygen, for an average value of 5.5 weight percent. The oxygen content in the slag for the Cu-containing alloys was five times higher than in the slag for the alloys without Cu.

EXAMPLE 4

The mass of the slag for the alloy heats prepared with and without including Cu during the alloy preparation were also measured and compared. For the three samples from Example 1, without the inclusion of Cu, the masses were 320 grams, 194 grams, and 232 grams, for an average mass of 249 grams. Because the preparation had an initial mass of 2270 grams (5 lbs), the yield without Cu inclusion was (2270−249)/2270=89 percent.

With the Cu inclusion, the slag of the three alloy heats from Example 2 had masses of 172 grams, 166 grams, and 218 grams, for an average value of 185 g. The yield was thus (2270−185)/2270=92 percent. The inclusion of Cu therefore resulted in an improved yield with the reduction in slag.

EXAMPLE 5

Two alloy heats were prepared similarly to Example 2, again with raw material taken from the same lot as Example 1 to avoid variation in the raw material affecting the quality of the melt, except that 0.5 weight percent and 1.0 weight percent Cu were added. The mass of the slag was measured and found to be 213 grams for the 0.5 weight percent Cu sample and 191 grams for the 1.0 weight percent Cu sample. These values are lower than those that did not have added Cu in EXAMPLE 4.

Each of the ingots produced in Examples 1–5 is clean in appearance and the furnace in which they were prepared is easily cleaned. This qualitative result is consistent with the low oxygen content of the ingots.

EXAMPLE 6

Six alloys were prepared with the following composition: 27.2 weight percent total rare earth (which consisted primarily of Nd and Pr), 0.9 weight percent boron, 5.0 weight percent cobalt, and balanced with iron. To each of the alloys was added a different amount of Cu between 0.0 weight percent and 0.70 weight percent. The alloys were melt spun to an overquenched microcrystalline condition and annealed to achieve optimal magnetic properties. The resulting microcrystalline ribbons were subsequently crushed to form powders. The magnetic properties of the various powders were measured and the results are summarized in Table I.

TABLE I

| Cu content (weight percent) | $B_r$ (kG) | $H_{ci}$ (kOe) | $BH_{max}$ (MGOe) |
|---|---|---|---|
| 0.00 | 7.9 | 7.9 | 10.5 |
| 0.11 | 7.7 | 8.4 | 10.1 |
| 0.22 | 7.7 | 8.4 | 10.4 |
| 0.39 | 7.7 | 8.3 | 9.9 |
| 0.54 | 7.6 | 7.9 | 9.2 |
| 0.70 | 7.5 | 7.8 | 8.7 |

The magnetic properties tabulated are the remanence $B_r$, the intrinsic coercivity $H_{ci}$, and the maximum energy product $BH_{max}$.

An examination of the results of measuring the magnetic properties for powders prepared with different amounts of Cu reveals that $H_{ci}$ increases with Cu content until approximately 0.22 weight percent Cu and decreases thereafter until 0.70 weight percent Cu. The maximum energy product is nearly the same with up to 0.22 weight percent Cu and decreases thereafter.

EXAMPLE 7

Three alloys were prepared with the following composition: 28.0 weight percent total rare earth (which consisted primarily of Nd and Pr), 1.0 weight percent boron, 15.5 weight percent cobalt, and balanced with iron. Cu was included in two of the alloys in the amount of 0.25 weight percent and 0.45 weight percent. As in Example 6, the alloys were melt spun to an overquenched microcrystalline condition and annealed to achieve optimal magnetic properties. Powders were formed by crushing the resulting microcrystalline flakes. Table II summarizes the magnetic properties measured from the powders.

TABLE II

| Cu content (weight percent) | $B_r$ (kG) | $H_{ci}$ (kOe) | $BH_{max}$ (MGOe) |
|---|---|---|---|
| 0.00 | 8.1 | 9.8 | 12.9 |
| 0.25 | 8.0 | 9.9 | 12.7 |
| 0.45 | 8.0 | 8.6 | 11.9 |

Although the addition of Cu does not affect $B_r$ significantly, there is a considerable decrease in the values of $H_{ci}$, and $BH_{max}$ beyond 0.25 weight percent Cu addition.

EXAMPLE 8

A 3000 lb heat was taken with 0.1 weight percent Cu included in an alloy with 27.3 weight percent total rare earth (which consisted primarily of Nd and Pr), 5.0 weight percent Co, 0.9 weight percent boron, and balanced with iron. It was melt spun to an overquenched condition and annealed. The annealed powder had an oxygen content of 0.04 weight percent, which is lower than the normal value of 0.06 weight percent without Cu addition.

EXAMPLE 9

80 lb ingots was made with the following composition: 27.3 weight percent total rare earth, 5.0 weight percent cobalt, 0.9 weight percent boron, and balanced with iron. To one of the ingots was added 0.13 weight percent Cu. The ingots were melt spun to an overquenched condition and annealed at 640° C. Both samples were subsequently aged at 125° C. for 1000 hours, with measurements of the oxygen content being taken initially, at 500 hours, and at 1000 hours. The results of these measurements are summarized in Table III.

TABLE III

| Time (hours) | Sample without Cu (weight percent) | Sample with Cu (weight percent) |
|---|---|---|
| Initial | 0.070 | 0.039 |
| 500 | 0.097 | 0.055 |
| 1000 | 0.120 | 0.065 |

The oxygen content of the sample with added Cu was approximately 55 percent of the oxygen content of the sample without added Cu at every time measured. Even after aging at 125° C. for 1000 hours, the oxygen content of the sample with added Cu had not even risen to the initial value of the oxygen content for the sample without added Cu.

EXAMPLE 10

The oxygen content in two of the samples of Example 6 were analyzed. In the sample without Cu included, the oxygen content was 0.059 weight percent. In the sample with 0.11 weight percent Cu, the oxygen content was significantly less, with only 0.037 weight percent.

EXAMPLE 11

Four alloy heats were made in 5 lbs vacuum induction furnace having the following composition: 30.5 weight percent total rare earth, 0.9 weight percent boron, and balanced with iron. Different combinations of elements were added to each of the four alloy heats, and the oxygen content of the ingots measured. In the first, 0.2 weight percent Cu and 5 weight percent cobalt were added, resulting in an oxygen content of 0.013 weight percent. In the second, 0.2 weight percent Cu, 2.5 weight percent cobalt, and 2.5 weight percent dysprosium were added, resulting in an oxygen content of 0.015 weight percent. In the third, 0.2 weight percent Cu, 6.0 weight percent cobalt, and 0.6 weight percent gallium were added, resulting in an oxygen content of 0.013 weight percent. In the fourth, 0.2 weight percent Cu, 2.5 weight percent cobalt, 2.5 weight percent dysprosium, and 0.6 weight percent gallium were added, resulting in an oxygen content of 0.009 weight percent.

In each of these cases, the oxygen content is low, consistent more with the results from Example 2 than the results from Example 1, which were for alloys untreated by Cu.

EXAMPLE 12

An alloy with the following composition was melt spun with and without including 0.1 weight percent Cu: 27.2 weight percent Nd, 1.4 weight percent boron, and balanced with iron. The oxygen content in the crushed ribbon was 0.036 weight percent in the alloy without Cu and 0.018 weight percent in the alloy including 0.1 weight percent Cu As for the other examples, this illustrates that including copper in the melt is helpful in reducing the oxygen content in the melt-spun ribbon.

Thus, the invention relates to the inclusion of Cu to rare earth-iron-boron alloys during melting. Preferably, the Cu is included up to 0.2 weight percent. The examples described above demonstrate that the inclusion of Cu reduces the oxygen content of the alloy and improves the metal yield without any significant variation in the magnetic properties of the annealed powder. The Cu inclusion also reduces the oxygen content in the rapidly solidified material. Alloy ingots prepared by the process of the invention are clean in appearance and crucibles used during the process may be cleaned easily.

It should be apparent to those skilled in the art that minor amounts of other elements, such as W, Cr, Ni, Al, Mg, Mn, V, Mo, Ti, Ta, Zr, C, Sn, and Ca, may be present in the composition without substantially adversely affect the magnetic properties of the resulting magnets. Preferably, the amounts of these elements, either alone or in combination, do not exceed 2 percent of the composition. In addition, small amounts of Si, O and N may also be present in the composition.

Although the present invention has been described with reference to examples, it will be appreciated by those of ordinary skill in the art that modifications can be made to the structure and form of the invention without departing from its spirit and scope, which is defined in the following claims.

What is claimed is:

1. A process for preparing a rare earth-iron-boron alloy comprising the steps of:

(a) preparing a melt having a composition comprising:

(i) one or more rare-earth elements selected from the group consisting of Y, La, Ce, Pr, Nd, Sm, Er, Gd, Tb, Dy, Ho, Er, Tm, Yb, and Lu;

(ii) boron;

(iii) iron; and (iv) copper in an amount of less than 0.25 weight percent; and (b) solidifying said melt;

whereby said alloy has reduced oxygen content compared with an alloy prepared by a process where said melt lacks said copper.

2. The process according to claim 1, wherein the composition of said melt further comprises cobalt.

3. The process according to claim 1, wherein the composition of said melt further comprises dysprosium.

4. The process according to claim 1, wherein the composition of said melt further comprises gallium.

5. The process according to claim 1, wherein said compositioncomprises approximately 15 to 34 weight percent of said one or more rare earth elements, and 0.8 to 1.4 weight percent of said boron.

6. The process according to claim 5, wherein said one or more rare earth elements are selected from the group consisting of Nd and Pr.

7. The process according to claim 1, wherein said Cu is included in said melt in the form of pure Cu.

8. The process according to claim 1, wherein said Cu is included in a proportion comprising less than 0.2 weight percent of said composition.

9. The process according to claim 1, wherein said step of solidifying comprises cooling said melt.

10. The process according to claim 1, wherein said step of solidifying comprises melt spinning.

11. A peocess for preparing a rare earth-iron-boron alloy comprising the steps of:

(a) preparing a melt having a composition comprising:

(i) one or more rare-earth elements selected from the group consisting of Y, La, Ce, Pr, Nd, Sm, Er, Gd, Tb, Dy, Ho, Er, Tm, Yb, and Lu;

(ii) boron;

(iii) iron; and (iv) copper in an amount of less than 0.25 weight percent; and (b) solidifying said melt;

whereby said process has improved yield compared with a process where said melt lacks said copper.

12. The process according to claim 11, wherein the composition of said melt further comprises cobalt.

13. The process according to claim 11, wherein the composition of said melt further comprises dysprosium.

14. The process according to claim 11, wherein the composition of said melt further comprises gallium.

15. The process according to claim 11, wherein said composition comprises approximately 15 to 34 weight percent of said one or more rare earth elements, and 0.8 to 1.4 weight percent of said boron.

16. The process according to claim 15, wherein said one or more rare earth elements are selected from the group consisting of Nd and Pr.

17. The process according to claim 11, wherein said Cu is included in the form of pure Cu.

18. The process according to claim 11, wherein said Cu is included in a proportion comprising less than 0.2 weight percent of said composition.

19. The process according to claim 11, wherein said step of solidifying comprises cooling said melt.

20. The process according to claim 11, wherein said step of solidifying comprises melt spinning.

21. A process for preparing a permanent rare earth-iron-boron magnet comprising the steps of:

(a) preparing a melt having a composition comprising:

(i) one or more rare-earth elements selected from the group consisting of Y, La, Ce, Pr, Nd, Sm, Er, Gd, Tb, Dy, Ho, Er, Tm, Yb, and Lu;

(ii) boron;

(iii) iron; and (iv) copper in an amount of less than 0.25 weight percent;

(b) solidifying said melt; and (c) fabricating said permanent rare earth-iron-boron magnet from said solidified melt;

wherein said magnet has reduced oxygen content compared with a magnet prepared by a process where said melt lacks said copper.

22. The process according to claim 21, wherein the composition of said melt further comprises cobalt.

23. The process according to claim 21, wherein the composition of said melt further comprises dysprosium.

24. The process according to claim 21, wherein the composition of said melt further comprises gallium.

25. The process according to claim 21, wherein said composition comprises approximately 15 to 34 weight percent of said one or more rare earth elements, and 0.8 to 1.4 weight percent of said boron.

26. The process according to claim 25, wherein said one or more rare earth elements are selected from the group consisting of Nd and Pr.

27. The process according to claim 21, wherein said Cu is included in the form of pure Cu.

28. The process according to claim 21, wherein said Cu is included in a proportion comprising less than 0.2 weight percent of said composition.

29. The process according to claim 21, wherein said step of solidifying comprises cooling said melt.

30. The process according to claim 21, wherein said step of solidifying comprises melt spinning.

* * * * *